US005082137A

United States Patent [19]

Weinstein

[11] Patent Number: 5,082,137

[45] Date of Patent: Jan. 21, 1992

[54] CHILD RESISTANT SLIDE BOX

[75] Inventor: Jack Weinstein, Manchester Township, Ocean County, N.J.

[73] Assignee: Primary Delivery Systems, Inc., Flemington, N.J.

[21] Appl. No.: 641,383

[22] Filed: Sep. 21, 1990

[51] Int. Cl.[5] ..... B65D 43/20

[52] U.S. Cl. ..... 220/346; 206/1.5; 206/540

[58] Field of Search ..... 220/281, 346, 347, 350; 206/1.5, 540

[56] References Cited

U.S. PATENT DOCUMENTS

| | | | |
|---|---|---|---|
| 3,888,350 | 6/1975 | Hervath | 206/531 |
| 3,942,630 | 3/1976 | Phillips | 206/1.5 |
| 4,113,098 | 9/1978 | Howard | 206/540 |
| 4,174,034 | 11/1979 | Hoo | 206/1.5 |
| 4,284,204 | 8/1981 | Carey, Jr. | 220/346 |
| 4,561,544 | 12/1985 | Reeve | 206/540 |
| 4,844,284 | 7/1989 | Drozd et al. | 220/281 |

*Primary Examiner*—Stephen P. Garbe

*Assistant Examiner*—Nova Stucker

*Attorney, Agent, or Firm*—Kenneth P. Glynn

[57] ABSTRACT

The present invention is directed toward a child resistant locking slide box that is opened by deforming a locking tab on the slide box drawer that positively engages the surrounding cover. There are tracks on the inside surfaces of the cover side walls that positively engage and slide along tracks positioned on the outside surfaces of the drawer side walls. The engagement of the cover and draw tracks allow only for the respective lateral movement of the cover across the drawer. The lateral movement of the cover allowed by the tracks is restricted in one direction by the cover end tabs, and in the other direction by the drawer locking tab.

The drawer locking tab has a step that overlaps the cover surface. To open the slide box the cover tab must first be deformed backward, removing the step from above the cover, and then downward so that the whole locking tab is beneath the cover. Once the draw tab is below the cover, the drawer can be pushed past the cover, exposing the contents of the drawer.

17 Claims, 4 Drawing Sheets 1
13
9
19
F
14
21
7
11
15
27
3
5
29
31
33

2
75
81
77
73
71
79
83
87
85
63
65
89
55
56
69
67
59
57
58
61
53
51

CHILD RESISTANT SLIDE BOX

BACKGROUND OF THE INVENTION

1. Field of the Invention

The present invention is directed toward a child resistant slide box container, and more particularly to such slide box containers that have a drawer that positively engages a protective cover, preventing the removal of the cover until the drawer is deformed in a specific area and manner by a user.

2. Prior Art Statement

Slide boxes are a very old and commonly used technology. The most popular use of a slide box is probably for the storage of wooden matches, and has been so for over two centuries. The slide boxes popularity stems from its unique ability to efficiently store small loose items, in such a manner, as to isolate those items from its surroundings, and assure the stored items remain in a flat orientation. The attributes of slide boxes, have facilitated its adaptation to pharmaceuticals, pesticides, deodorants and other products that need protection from, or limited exposure to, the surrounding environment. Because of the nature of products stored within slide boxes, it has become important to create slide boxes within a child resistant capability. The most popular means of creating a child resistant slide box, is by creating slide box with a positively engaging drawer and cover. Usually the engagement is released when either the drawer or the cover is deformed by the user in a specific location. The prior art exemplifying this design form is as follows:

U.S. Pat. No. 3,888,350 to Horvath shows a slide box in which a tab on the cover prevents the drawer from passing. The cover has stress deflection points created within it, so that when the cover is pressed from the sides, the cover will buckle upwards lifting the locking tab away from the drawer and permitting its free movement;

U.S. Pat. No. 4,113,098 to Howard has a lock/unlock mechanism very similar to the Horvath patent. As the cover of the slide box is pressed the top buckles upward, disengaging the cover locking tab over the drawer locking tab, allowing the movement of the drawer;

U.S. Pat. No. 4,174,034 to Hoo teaches a slide box that has a cover with a deformation relief, and a drawer with a protruding locking tab. As the cover is pressed from its sides, the deformation relief lifts above the range of the drawer locking tab allowing the drawer to move freely; and U.S. Pat. No. 4,844,284 to Drozd, et al, shows a cover with side locking tabs that grip the drawer. As the cover is deformed downwardly in its middle, the side locking tabs expand outwardly, disengaging from the drawer and allowing the drawer to move.

In addition to child resistant slide boxes that unlock from the effects of an indirect cover deformation, there are child resistant slide boxes that unlock from the direct disengagement of the locking tabs. These patents are as follows:

U.S. Pat. No. 4,561,544 to Reeve shows a drawer with a spring lock that fits into a cover orifice. To open the slide box, the spring lock is simply pressed away from the cover orifice as the drawer is pulled open;

U.S. Pat. No. 3,987,891 to Horvath shows a drawer with locking tabs on its sides that engages cover tabs, the cover is deformed at the area of the drawer locking tabs, disengaging the two and allowing the drawer to move freely; and U.S. Pat. No. 4,730,731 to Allison is a hinged flip top box that has a deformation point that moves the bottom lock away from the cover lock allowing the lid to be opened.

Thus, although prior art does show child resistant slide boxes that have deformation points that allow for the disengagement of locking tabs for a given applied force, prior art neither teaches nor suggests the type of locking device or the orientation of locking/unlocking movements described by the present invention.

SUMMARY OF THE INVENTION

The present invention is directed toward a child resistant locking slide box that is opened by deforming a locking tab on the slide box drawer that positively engages the surrounding cover. The slide box consists of a drawer created from a flexible material that has at least one locking tab that extends past the cover plane. The cover has two side walls and a blocking tab at one of its open ends. There are tracks on the inside surfaces of the cover side walls that positively engage and slide along tracks positioned on the outside surfaces of the drawer side walls. The engagement of the cover and drawer tracks allow only for the respective lateral movement of the cover across the drawer. The lateral movement of the cover allowed by the tracks is restricted in one direction by the cover end tabs, and in the other direction by the drawer locking tab. With the drawer locking tab in place, the cover can not move and can not be forced open by a child.

The drawer locking tab has a step that overlaps the cover surface. To open the slide box the cover tab must first be deformed backward, removing the step from above the cover, and then downward so that the whole locking tab is beneath the cover. Once the drawer tab is below the cover, the drawer can be pushed past the cover, exposing the contents of the drawer. The needed backward deformation of the drawer locking tab is accomplished in one of two ways. Either the cover spring tabs are created with a stress relief that allows them to elastically deform backward, or the drawer locking tab itself is created with the needed stress reliefs. Either orientation allows the locking tab to be elastically deformed both in the up/down and rearward/forward directions. The compounded motion of pulling the drawer locking tab backward, pushing it below the cover, and pushing the drawer forward, creates a slide box that is resistant to children of most all ages. Yet the compound motion is easily mastered by an adult, removing the frustrations about use and the concerns about safety common with most child resistant packaging.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE INVENTION

The present invention is, as mentioned, directed toward a child resistant slide box that is normally locked and can not be opened by the manipulation of a child. In the past, a large variety of items, from match sticks to pills, have been stored in slide boxes. Slide boxes protect their contents from coming into contact with the surrounding environment, and shallow slide boxes prevent its contents from losing a desired flat orientation. Slide boxes also have the added feature of having a variable opening, thus limiting contact with the outside environment, or limiting the removal rate of material from the slide box. The characteristics of slide boxes lend themselves to the storage of potentially hazardous or dangerous materials. Slide boxes are ideal for storing matches, pills, foil packs, cigarettes and other items that are best preserved flat, oriented and protected from the environment. Also, slide boxes are often used to hold insect traps, rodent poison, room deodorizers, air quality testers and the like that are best protected before and after use. Because of the substances often stored within slide boxes, it is often desirable to create those slide boxes so that it is child resistant.

Child resistant slide boxes have been in existence for decades. However, some slide boxes are more child resistant than others. Child resistance is a term of art and a child resistant package can be created that a four or five year old child may not be able to open but that a six or seven year old may open with little effort. Still other child resistant packages may be developed that are so complex or difficult, that the elderly, weak, or illiterate may not be able to open the container. The present invention slide box requires a compounded action to open. Unlike other child resistant slide boxes that require only a large force to be applied in an indicated region to open, the present invention derives its child resistance from a combination of force and understanding that is common to most every adult but absent in all but the oldest children. To open the present invention slide box, a user must first pull back on the locking tab and then must push down the locking tab and simultaneously push forward on the slide box drawer. This opening procedure would be obvious to any adult, but the understanding capabilities of children are not fully developed and the combination of the manipulation of force, and the visualization of the forces effect in opening the invention, will prevent most all children from successfully opening the slide box. In addition, the compound movements needed to open the present invention, insure that a child playing with the slide box will not accidentally open the slide box with a lucky application of force.

Figure 1:
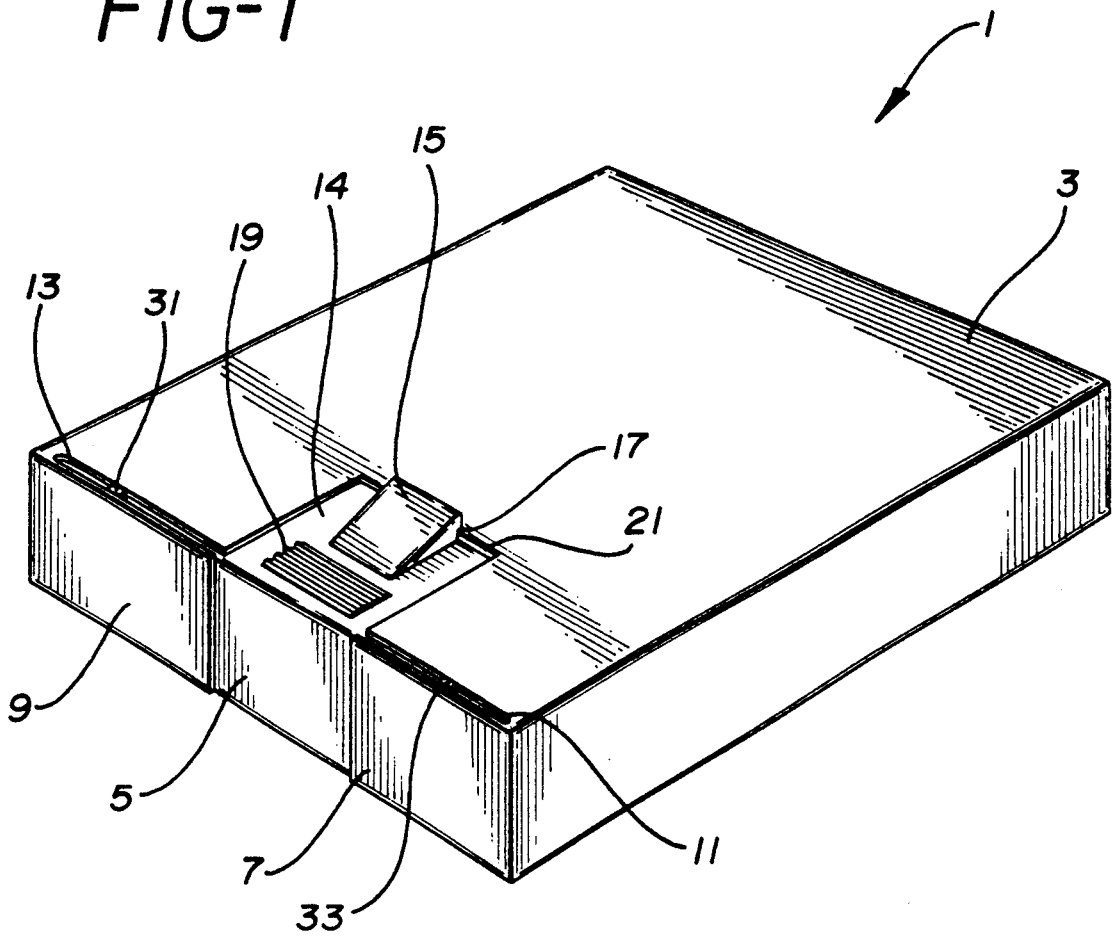
FIG. 1 shows a perspective view of one preferred embodiment of the present invention in a closed locked orientation.

Referring now to FIG. 1, there is shown one preferred embodiment of the present invention 1. The invention 1 is made of two primary parts, the drawer 5 and a cover 3. The cover 3 has dependent side members that cover the sides of drawer 5, and end spring tabs 9 and 7 that partially cover the forward end of the drawer 5. The tabs 9 and 7 are partially separated from the top surface of the cover 3 by two slots 11 and 13. The slots assure that the spring tabs 9 and 7 are primarily dependent from the side wall members of the cover 20 so that the spring tabs 9 and 7 can elastically deform away from the top surface of the cover 3. The locking mechanism of the present invention 1 is created by the lock tongue 14 of the drawer 5. The lock tongue 14 is dependent upon the forward wall of the drawer 5 and its location responds to the gap in the forward wall of the cover 3 between locking tabs 7 and 9. The lock tongue 14 fills the recess that is formed in the top surface of the cover 3 and the tab 15 atop the lock tongue 14, has a stepped configuration 17. The tab 15, due to its stepped configuration 17 both engages and overlaps the exposed edge 21 of the cover recess, preventing the tab 15 from being pushed below the cover 3, and preventing the withdrawal of the drawer 5 from the cover 3.

Figure 2:
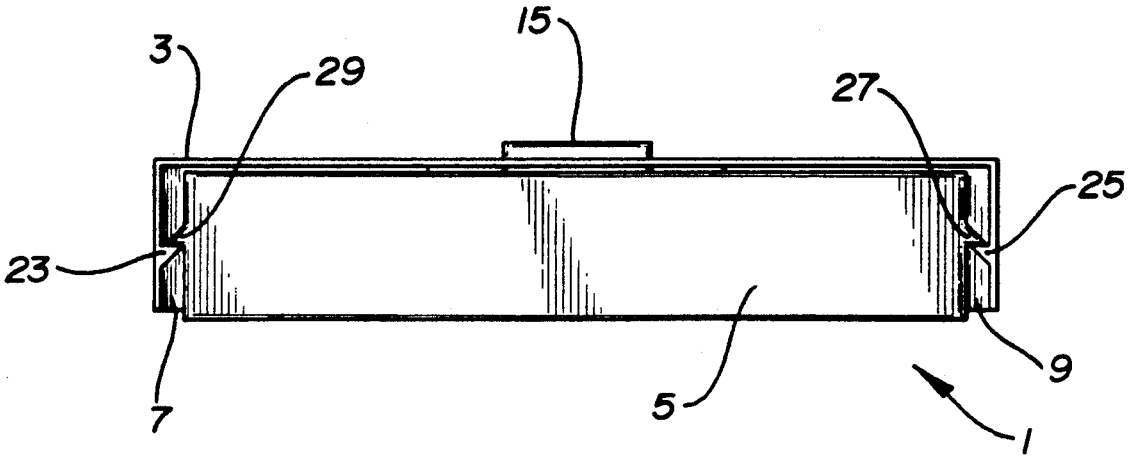
FIG. 2 shows a rear view of the embodiment depicted in FIG. 1.

FIG. 2 is a rearward view of the present invention 1 depicted in FIG. 2 with like parts being like numbered and best shows how the drawer 5 and the cover 3 are slidably engaged. As shown in FIG. 2 the drawer 5 has a ledge 27 and 29 protruding from each external side wall surface. And the cover 3 has a ledge 23 and 25 extending from the interior of its side wall surfaces. The drawer ledges 27, 29 and the cover ledges 25, 23 are so oriented so that the ledges overlap along a flat surface. The overlap of the ledges holds the drawer 5 firmly to the cover 3 yet lets both be moved laterally along the ledges 23, 25, 27, 29.

Figure 3:
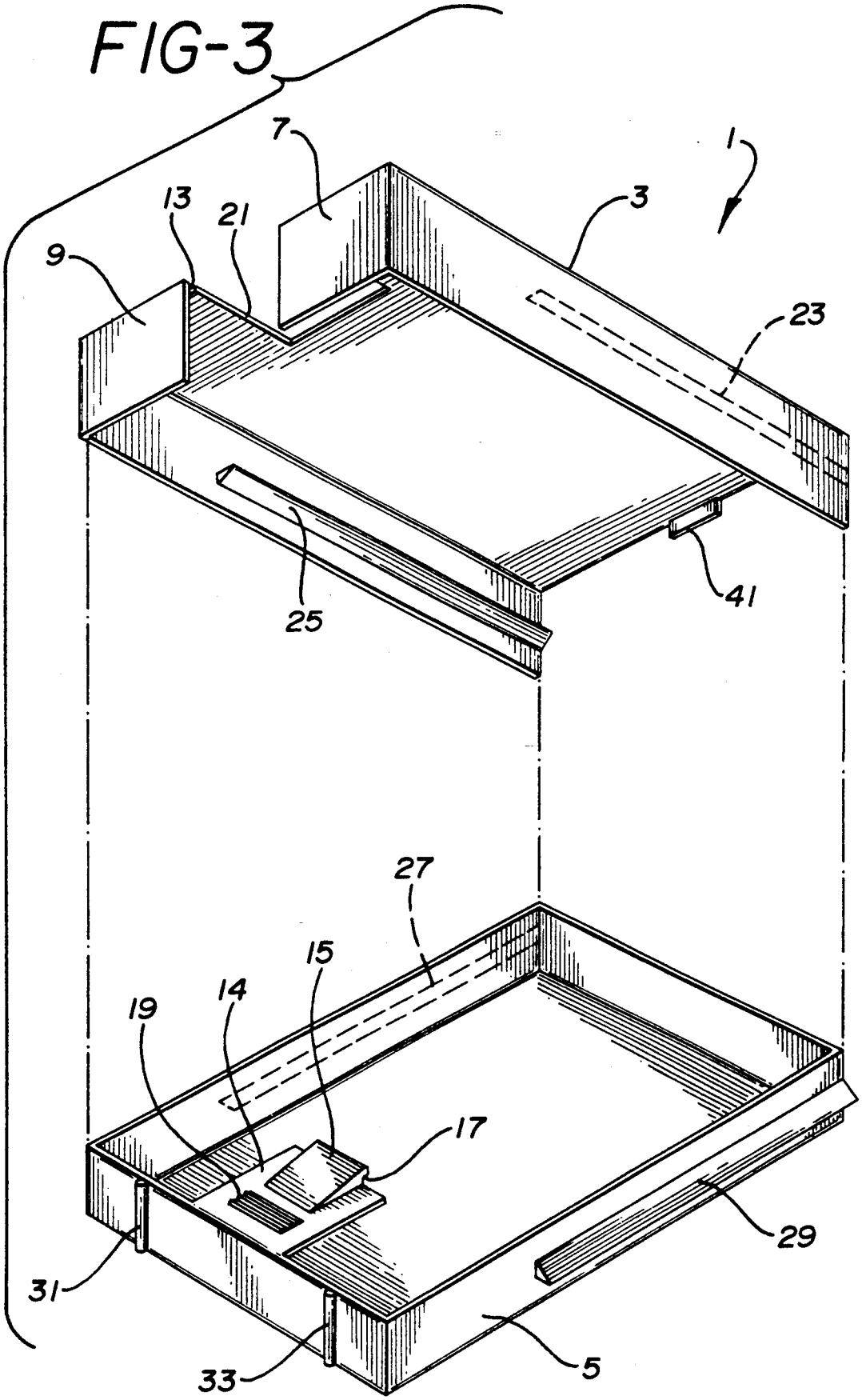
FIG. 3 shows an exploded perspective view of the embodiment depicted in FIGS. 1 and 2.

FIG. 3 is an exploded perspective view of the present invention 1 depicted in FIGS. 1 and 2 with like parts being like numbered. FIG. 3 best shows the interworkings of the invention 1. The drawer 5 has four walls, the side walls each have a locking ledge 25, 29 and the forward wall has the locking tongue 14 dependent thereon. The forward wall of the drawer 5 has two bumpers 31 and 33 that help the drawer 5 engage and deform the spring tabs 9 and 7 of the cover 3. Although two bumpers 31, 33 are shown, no bumpers or many bumpers can be used with varying degrees of effectiveness. The cover 3 has ledges 25, 23 that engage the drawer 5 ledges 27 and 29 respectively. The cover has an end stop 41 that restricts the amount of lateral travel between the cover 3 and the drawer 5. When the cover 3 is placed on the drawer 5, the lock tongue 14 fills the space left open in the cover 3. The drawer ledges 27 and 29 engage the cover ledges 25 and 23, and the cover is prevented from moving laterally along the ledges by the bumpers 31, 33 touching the spring tabs 9, 7 and the lock tab 15 engaging the edge of the cover recess 21.

Figures 4, 5, 6:
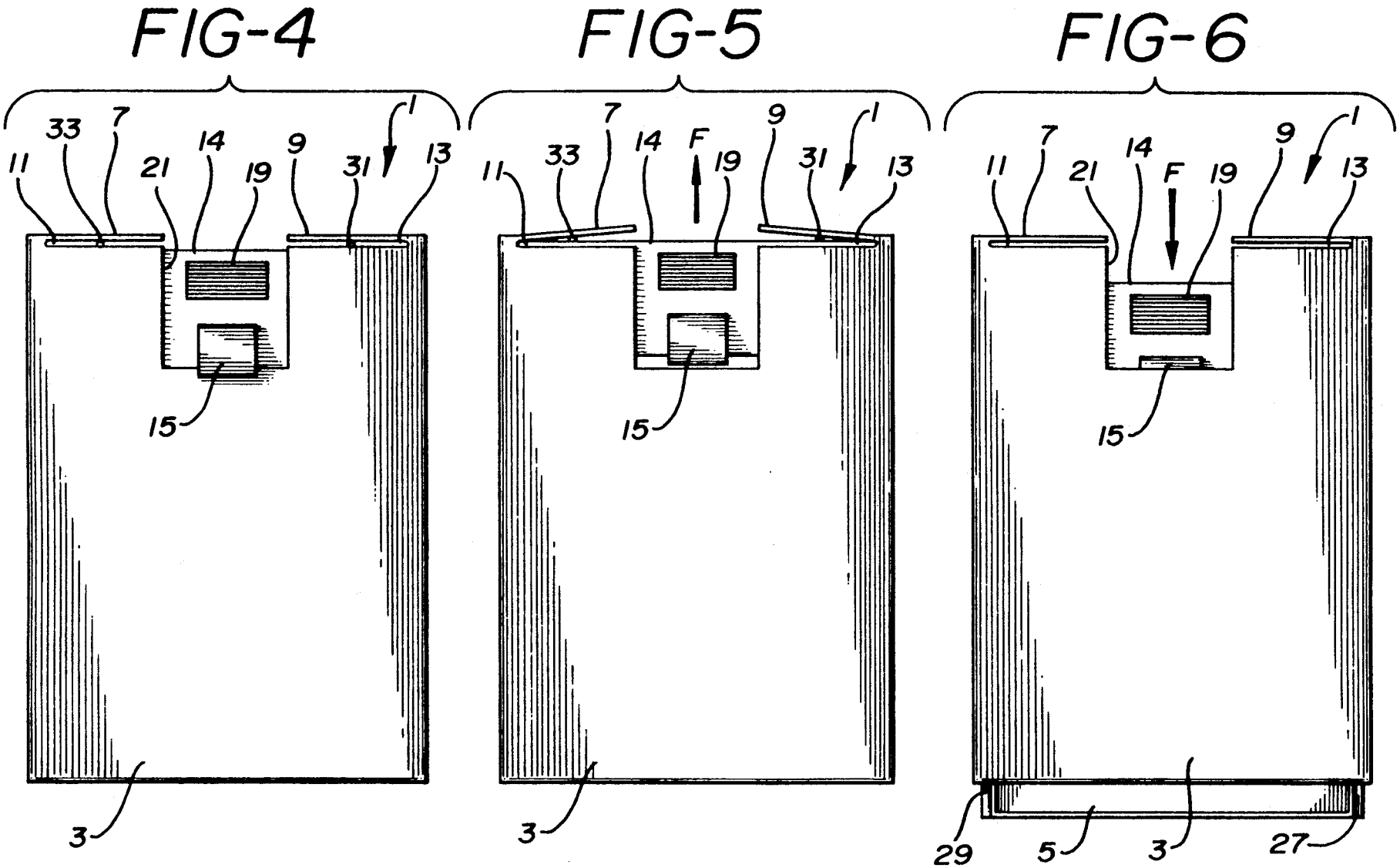
FIGS. 4, 5, and 6 are front views of the preferred embodiment depicted in FIGS. 1, 2 and 3, shown at various stages during opening; and, FIG. 7 is an exploded perspective view of an alternative embodiment of the present invention.

The process of opening and closing the present invention 1 is best shown in FIGS. 4, 5 and 6 which depict a top view of the present invention 1 during various positions during opening (or closing). Referring first to FIG. 4, the present invention 1 is shown in its closed locked position. The cover spring tabs 7, 9 are linear and the locking tab 15 is overlapping the cover recess edge 21. Referring now to FIG. 5 the first step in opening the invention 1 is depicted. A force F is applied to the locking tab 14, usually applied to the thumbpad 19. The force F is transferred to the drawer 5, forcing the drawer bumpers 33 and 31 against the cover spring tabs 7 and 9. The spring tabs 7, 9 deform allowing the drawer 5 to move backward and allowing the locking tab 15 to clear the cover recess edge 21. Once the locking tab 15 is clear of the cover recess edge 21, the locking tab 15 is pushed downward (force not shown) forcing the locking tab 15 below the planar surface of the cover 3. Referring now to FIG. 6, once the locking tab 15 is pressed below the cover 3, the force F is reversed and the drawer 5 is pushed past the cover 3. The drawer bumpers 33, 31 leave contact with the cover spring tabs 7, 9 and the spring tabs 7, 9 return to their original position. Since the locking tab 15 is below the cover 3, the entire lock tongue 14 is subducted beneath the cover 3. Since the lock tongue 14 no longer resists lateral movement, the drawer 5 can be pushed from beneath the cover 3, appearing from the far end of the cover. To close and lock the invention 1. The process is simply reversed until the locking tab 15 can be placed overlapping the cover recess edge 21.

Figure 7:
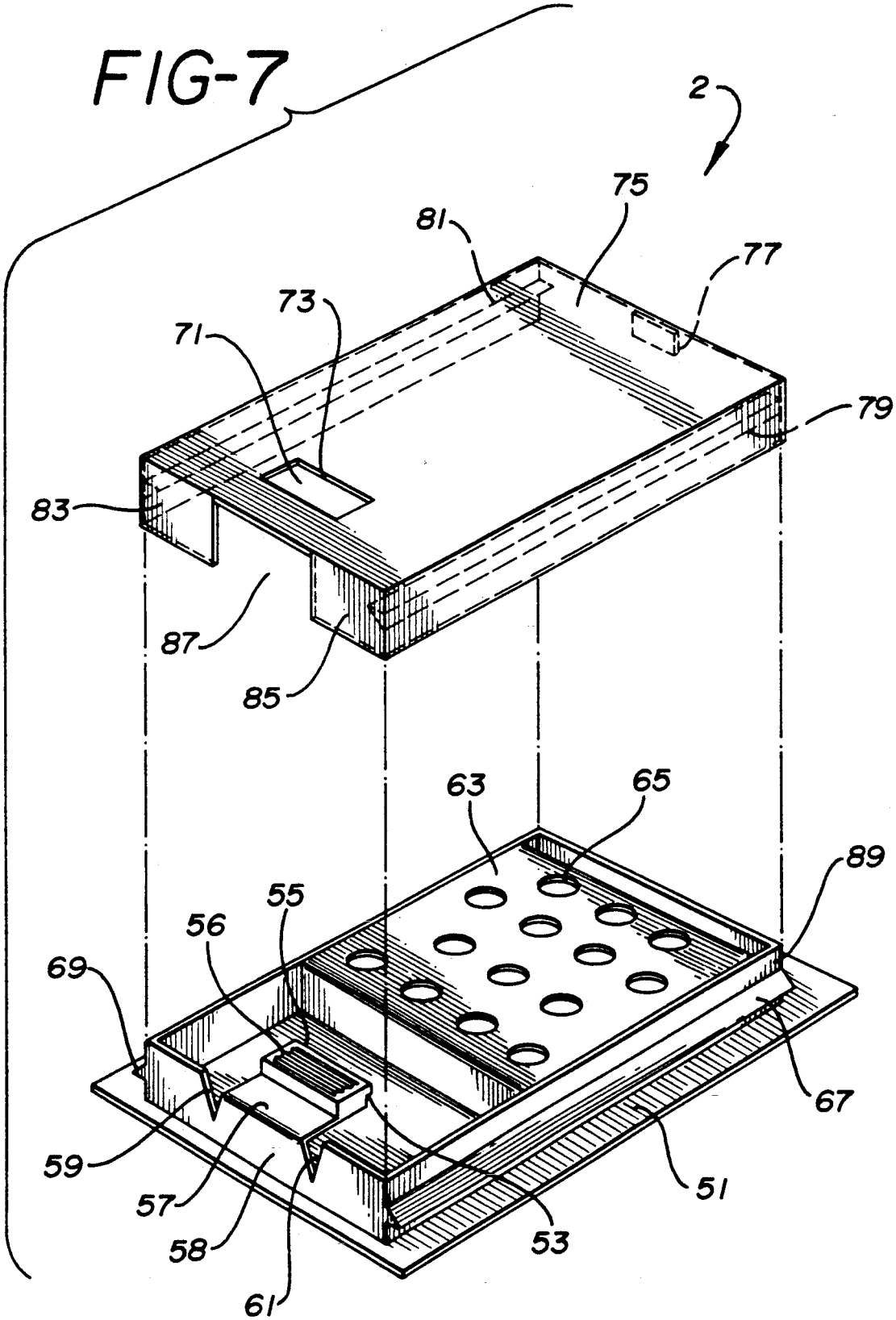

FIG. 7 shows an alternative embodiment for the present invention other than the one expressed in FIGS. 1 through 6. FIG. 7 shows an exploded perspective view of the present invention 2 holding a manufactured product 65 with a locking mechanism varying from that previously described. In the embodiment the forward wall members 83, 85 of the cover 75 are fully dependent and not separated from the top planar surface of the cover 75. The spring action previously shown in the spring tabs of the cover are now embodied in the forward wall members of the drawer 89. The forward wall member of the drawer 89 has two reliefs 59, 61 immediately adjacent to the forward wall section 58 that supports the lock tongue 57. The reliefs 59, 61 allow the supporting forward wall section 58 to deform independently from the remaining forward wall of the drawer 89. When the cover 75 is positioned on the drawer 89 the lock tongue 57 travels under the top planar surface of the cover 75 until it emerges through an orifice 71 formed within the cover 75. The lock tab 55 then overlaps and engages the back edge 73 of the cover orifice 71. To open this embodiment of the present invention 2. A force is applied to the locking tab 55 at the finger grip 56. The force is transferred to the forward supporting wall member 58 and the reliefs 59, 61 adjacent to the forward supporting wall member 58 allows it to elastically deform without substantially effecting the remainder of the forward wall of the drawer 89. The elastic deformation of the forward supporting wall member 58 allows the locking tab 55 to overcome its overlap with the rear edge 73 of the cover orifice 71. Once the overlap is erased the locking tab 55 can be pushed below the cover 75 and the cover 75 can be moved laterally across the draw 89. To close and lock the invention 2, the above described process is reversed until the locking tab 55 again overlaps the rear edge 73 of the cover orifice 71.

FIG. 7 also has the added feature of having a manufactured product 65 held within in the invention 2. The manufactured product 65 can be deodorant, insecticide, radon level tester, rodent trap, pill foil packs, or any other product that requires a cover before or after use. The manufactured product 65 can be made as an intricate part of the drawer 89 or the manufactured product 65 can be made as a removable and replaceable subcomponent. When produced as a replaceable subcomponent, the present invention slide box 2 can be repeatedly used to protect various products or different batches of the same product. For example, if the present invention slide box 2 is used to protect a foil pill pack, when the pill pack is emptied, a new foil pill pack can be substituted for the emptied pack. The replacement allows the present invention slide box to be reused, greatly reducing the unit cost of protected manufactured items, wherein a one time purchase of the present invention slide box 2 can protect an indefinite number of future refills.

FIG. 7 also shows the drawer 89 having an enlarged base 51 and the manufactured product 65 having a perforated lid 63. The enlarged base 51 is desirable in many situations, such as with rodent poison or adhesive rodent traps, where the forseeability of post-placement movement is high. The widened base prevents the drawer 89 from tipping over, thus preventing the contamination of the surrounding area by any of the manufactured product stored within. The perforated lid 63 can be used in conjunction with room deodorants, radon level testers, powered products or the like to further limit the amount of exposure the manufactured product 65 has with the surrounding environment. The perforated lid 63 may be protected by an adhesive foil (not shown), placed onto the perforated lid 63 by the manufacturer. The foil would protect the manufactured product 65 from contamination prior to use. The foil being removed manually from atop the manufactured product 65, when needed.

Obvious, in light of the above teachings, is that numerous modifications and variations of the present invention are possible. It is therefore understood that within the scope of the appended claims, that the invention may be practiced otherwise than is specifically described herein.

What is claimed is:

1. A child resistant container comprising in combination:

(a) a drawer having a substantially planar drawer bottom, a drawer forward wall member, a drawer rear wall member, and oppositely disposed drawer side wall members;

(b) a cover having a substantially planar top with a predetermined width, having depending oppositely disposed cover side wall members and at least one cover forward wall member and an open rear edge, said at least one cover forward wall member not traversing the full width of said planar top, an area wherein said cover planar top terminates with an open edge;

(c) a stop means depending from said cover for engagement with said drawer rear wall member to limit the relative sliding movement therebetween;

(d) a releasable locking means extending from said drawer forward wall member toward said drawer rear wall member, said locking means engaging and overlapping said open edge of said cover planar top; and, (e) interengaging slide means on said cover side wall members and said drawer side wall members.

2. A child resistant container as recited in claim 1, further comprising:

a slotted area substantially separating said at least one cover forward wall member from said cover planar top, whereby said at least one cover forward wall member is primarily extending from a cover side wall member, allowing said at least one cover forward wall member to be elastically deformed away from said cover planar top.

3. A child resistant container as recited in claim 2, further comprising:

at least one bumper extending from said drawer forward wall member whereby said bumper extends outwardly and is adapted to engage said at least one cover forward wall member.

4. A child resistant container as recited in claim 1, further comprising:

a plurality of slots formed within the said drawer forward wall member, adjacent to said locking means, whereby a portion of said drawer forward wall member supporting said locking means is substantially separated from a remaining portion said drawer forward wall member, allowing the portion of said drawer forward wall member supporting said locking means to be elastically deformed without substantially deforming said remaining portion of said drawer forward wall member.

5. The container of claim 1 wherein said interengaging slide means has a directed flange inside each cover side wall member in a slidably engaging relation with matching and opposing flanges outside each drawer side wall member.

6. The container of claim 1 wherein said open edge of said cover planar top is relieved a distance into said cover planar top away from said at least one cover forward wall member.

7. The container of claim 6 wherein said locking means extending from said drawer forward wall member toward said drawer rear wall member extends through said relieved area in an orientation substantially similar to said cover planar top, filling said relieved area.

8. The container of claim 1 wherein said cover planar top has an orifice cut therethrough.

9. The container of claim 8 wherein said locking means extending from said drawer forward wall member toward said drawer rear wall member extends under said cover and emerges through said orifice, engaging and overlapping said open edge of said cover planar top.

10. The container of claim 1 wherein said planar bottom of said drawer extends beyond said drawer forward wall member, drawer rear wall member and drawer side wall members.

11. The container of claim 1 wherein said at least one cover forward wall member may be elastically deformed by said drawer a predetermined distance when said drawer is engaged with said cover and is being opened, so as to eliminate said locking means overlapping of said open edge of said cover planar top and thereby to release said locking means.

12. The container of claim 2 wherein said at least one cover forward wall member may be elastically deformed by a force applied to said drawer a predetermined distance when said drawer is engaged with said cover and is being opened, so as to eliminate said locking means overlapping of said open edge of said cover planar top and thereby to release said locking means.

13. The container of claim 4 wherein said at least one cover forward wall member may be elastically deformed by a force applied to said drawer a predetermined distance when said drawer is engaged with said cover and is being opened, so as to eliminate said locking means overlapping of said open edge of said cover planar top and thereby to release said locking means.

14. The container of claim 11 wherein said locking means can be elastically deformed below said planar top of said cover.

15. The container of claim 12 wherein said locking means can be elastically deformed below said planar top of said cover.

16. The container of claim 13 wherein said locking means can be elastically deformed below said planar top of said cover.

17. The container of claim 1 wherein said locking means has a discernable area, an outer surface with said area being engageable for the application of forces by a user in moving said locking means away from said open edge of said cover planar top and deforming said locking means beneath said cover planar top so as to release said locking means.

* * * * *